US008033747B2

(12) United States Patent
Busam et al.

(10) Patent No.: US 8,033,747 B2
(45) Date of Patent: Oct. 11, 2011

(54) BINDER WITH MULTI-ACCESS POCKET

(75) Inventors: Edward P. Busam, Mason, OH (US); Dana M. Walker, Dayton, OH (US)

(73) Assignee: MeadWestvaco Corporation, Richmond, WA (US)

( * ) Notice: Subject to any disclaimer, the term of this patent is extended or adjusted under 35 U.S.C. 154(b) by 1693 days.

(21) Appl. No.: 10/803,730

(22) Filed: Mar. 18, 2004

(65) Prior Publication Data

US 2005/0207827 A1 Sep. 22, 2005

(51) Int. Cl.
*B42F 13/00* (2006.01)
*B42D 3/00* (2006.01)

(52) U.S. Cl. ..... 402/73; 402/70; 281/21.1; 281/29; 206/450

(58) Field of Classification Search ..... 283/36, 283/38, 40–42; 434/117, 162; 206/232, 206/450, 472, 475; 190/109, 111, 112; 402/4, 402/70, 73; 281/21.1, 29
See application file for complete search history.

(56) References Cited

U.S. PATENT DOCUMENTS

| | | | | | |
|---|---|---|---|---|---|
| 2,088,953 | A | * | 8/1937 | Greer | 281/31 |
| 2,180,191 | A | * | 11/1939 | Bauch | 190/111 |
| 2,487,220 | A | * | 11/1949 | Callaghan | 206/541 |
| 2,648,412 | A | * | 8/1953 | Meyers | 190/119 |
| 2,674,288 | A | * | 4/1954 | Laidlaw | 190/115 |
| 2,778,397 | A | * | 1/1957 | Carrasco | 190/119 |
| 2,797,719 | A | * | 7/1957 | Hume | 150/117 |
| 3,912,055 | A | * | 10/1975 | Malooly | 190/109 |
| 4,067,422 | A | | 1/1978 | Eberle | |
| RE29,751 | E | * | 9/1978 | Elias et al. | 312/184 |
| 4,840,258 | A | * | 6/1989 | Tomikawa et al. | 190/102 |
| 5,494,366 | A | * | 2/1996 | Pell et al. | 402/73 |
| 5,704,529 | A | | 1/1998 | Santoro et al. | |
| 5,749,447 | A | * | 5/1998 | Hersh et al. | 190/112 |
| 5,878,757 | A | | 3/1999 | Hernandez | |
| 5,911,441 | A | * | 6/1999 | Yamamoto et al. | 281/15.1 |
| D415,196 | S | | 10/1999 | Moor | |
| 6,059,079 | A | * | 5/2000 | Krulik | 190/112 |
| 6,059,478 | A | | 5/2000 | Moor | |
| 6,105,763 | A | | 8/2000 | Saetia | |
| 6,250,834 | B1 | | 6/2001 | Wien | |
| 6,276,722 | B1 | | 8/2001 | Moor | |
| 6,431,779 | B1 | | 8/2002 | Moor et al. | |
| 6,488,433 | B2 | * | 12/2002 | Wien et al. | 402/73 |
| 6,547,283 | B1 | * | 4/2003 | Moor | 281/44 |
| 6,558,062 | B1 | | 5/2003 | Wyant et al. | |
| 6,837,346 | B2 | * | 1/2005 | Hollingsworth | 190/11 |
| 7,077,596 | B1 | * | 7/2006 | Bianco et al. | 402/73 |
| 2009/0008203 | A1 | | 1/2009 | King et al. | |

FOREIGN PATENT DOCUMENTS

| | | |
|---|---|---|
| CA | 2367668 AA | 9/2000 |
| CA | 2391573 | 5/2001 |

* cited by examiner

*Primary Examiner* — Boyer D Ashley
*Assistant Examiner* — Sarah Addisu
(74) *Attorney, Agent, or Firm* — MWV Intellectual Property Group

(57) ABSTRACT

A binder including a first cover and a second cover pivotally coupled to the first cover, both of the covers being generally flat and planar and having a first and second opposite sides thereof. The binder further includes a pocket coupled to the first cover, wherein the pocket can be accessed from both the first and second sides of the first cover.

13 Claims, 6 Drawing Sheets

BINDER WITH MULTI-ACCESS POCKET

The present invention is directed to a binder, and more particularly, to a binder with a pocket which can be accessed from multiple sides of the binder.

BACKGROUND

Binders and other similar components may be used to store loose-leaf papers, bound notebooks, etc. Users of such notebooks also typically utilize handouts, papers, writing instruments and other accessories for use with the binder. Binders may include internal and/or external pockets for storing such components. However, access to internal pockets may be limited when the binder is in its closed position, and, conversely, it may be difficult or inconvenient to access the external pockets when the binder is in its open position. Accordingly, there is a need for a binder having a pocket which can be accessed from either inside and/or outside the binder.

SUMMARY

In one embodiment, the present invention is a binder having a pocket which can be accessed from either inside and/or outside the binder. In particular, in one embodiment, the binder includes a pocket located on one of the covers of the binder, wherein the pocket can be accessed from either side of the cover.

In one embodiment, the invention is a binder including a first cover and a second cover pivotally coupled to the first cover, both of the covers being generally flat and planar and having a first and second opposite sides thereof. The binder further includes a pocket coupled to the first cover, wherein the pocket can be accessed from both the first and second sides of the first cover.

In another embodiment, the invention is a binder including a first cover and a second cover pivotally coupled to the first cover, with both of the covers being generally flat and planar. The first cover includes an opening and has a first side and a second side. The binder further includes a pocket coupled to the first cover and generally received in the opening, the pocket including a first panel and a second panel defining a pocket cavity therebetween. The first panel is releasably attachable to the first side of the first cover and the second panel is releasably attachable to the second side of the first cover.

Other objects and advantages of the present invention will be apparent from the following description and the accompanying drawings.

DETAILED DESCRIPTION

Figure 1:
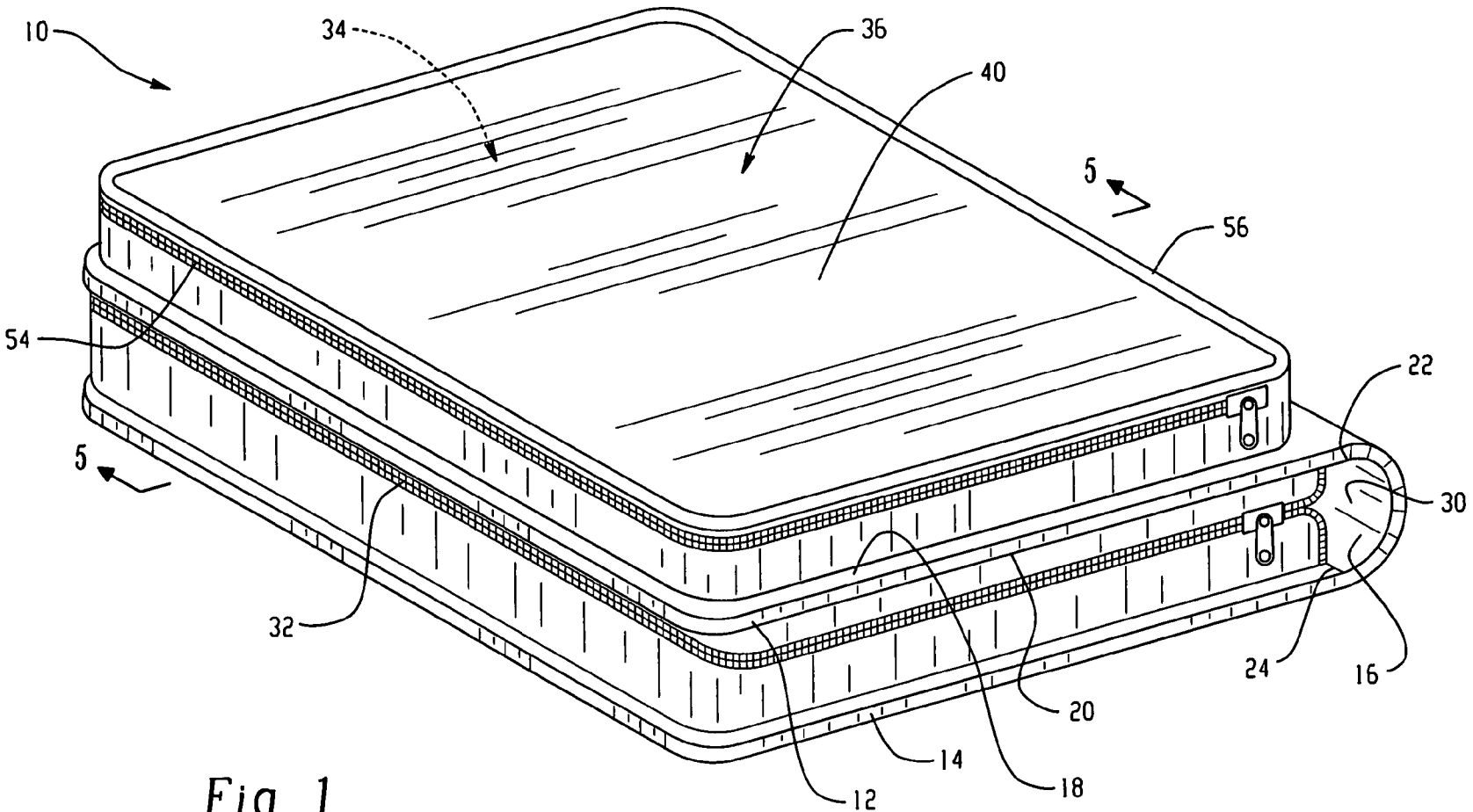
FIG. 1 is a front perspective view of one embodiment of the binder of the present invention, with the binder shown in its closed position and the pocket in its closed position.

As shown in FIGS. 1-6, in one embodiment the binder of the present invention, generally designated 10, may include a first or front cover 12, a second or rear cover 14, and a spine 16. Each of the front cover 12 and rear cover 14, and optionally the spine 16 may be generally flat and planar and generally rectangular in front view. The front cover 12 includes a first side 18 and a second side 20. The front cover 12 may define a plane, with the first side 18 being located on or defining the first side of the plane and the second side 20 being located on or defining the opposite side of the plane. Each of the front cover 12, rear cover 14 and spine 16 may be made of relatively stiff and/or rigid material (i.e., sufficiently rigid to support a stack of school components, such as several pounds, thereon without significant deformation).

The spine 16 may include a pair of opposed outer edges 22, 24, and each of the covers 12, 14 may be pivotally coupled to one of the edges 22, 24, respectively. In this manner, the front 12 and rear 14 covers are pivotally coupled together. The front 12 and rear 14 covers may be pivotal about a hinge line, or any of a variety of hinge lines located at or adjacent to the spine 16, one of which is shown as hinge line 26 in FIG. 3. The spine 16 may be generally flexible such that the spine 16 flexes during pivoting of the front 12 and rear 14 covers. The binder 10 may include a binding mechanism 28 (FIGS. 3 and 4), located on an inner surface 30 of the binder 10 such as on an inner surface of one of the covers 12, 14, or of the spine 16. In the illustrated embodiment the binding mechanism 28 is a three-ring binding mechanism.

Figure 2:
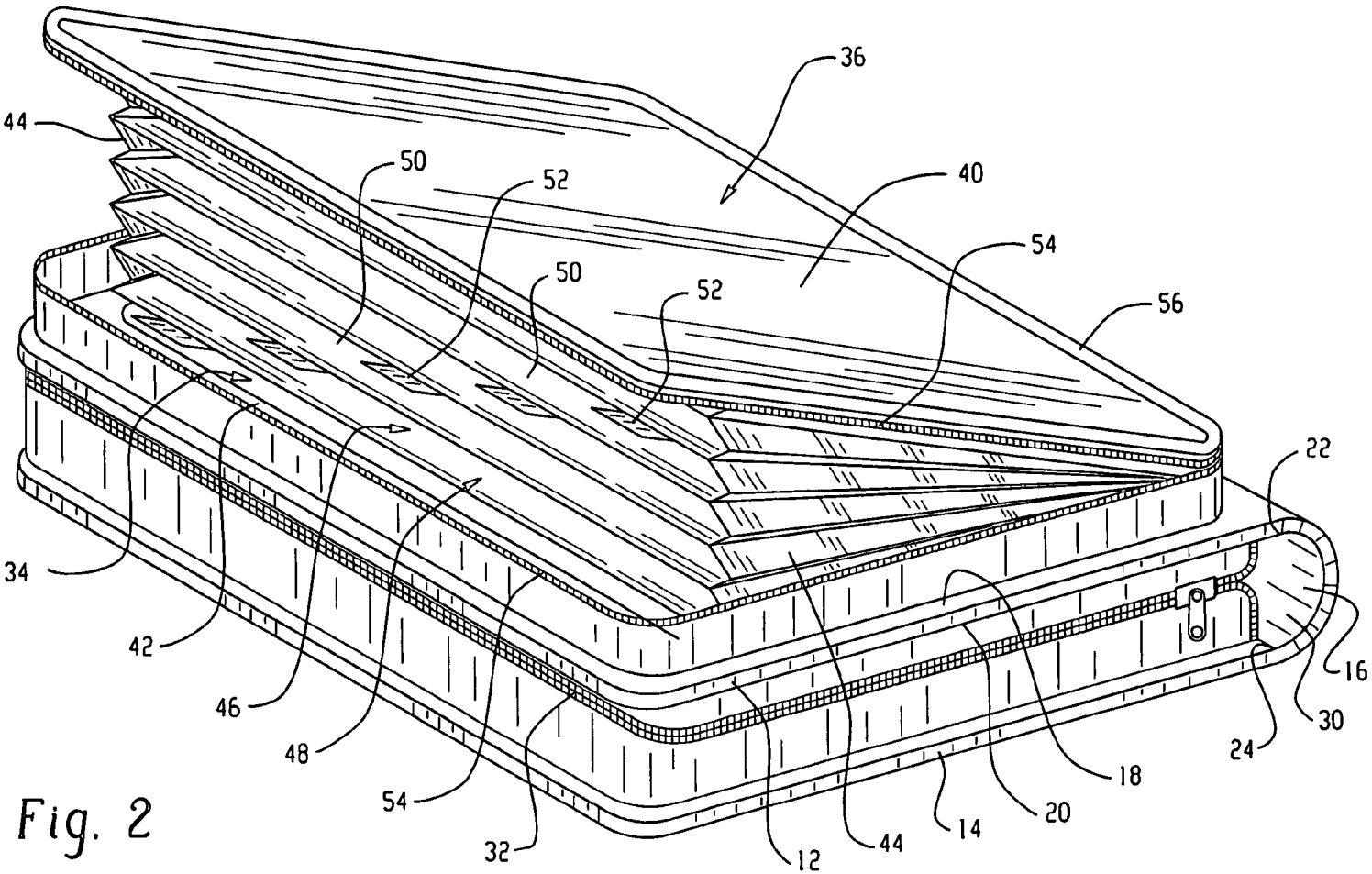
FIG. 2 is a front perspective view of the binder of FIG. 1, with the pocket in a first open position.
Figure 3:
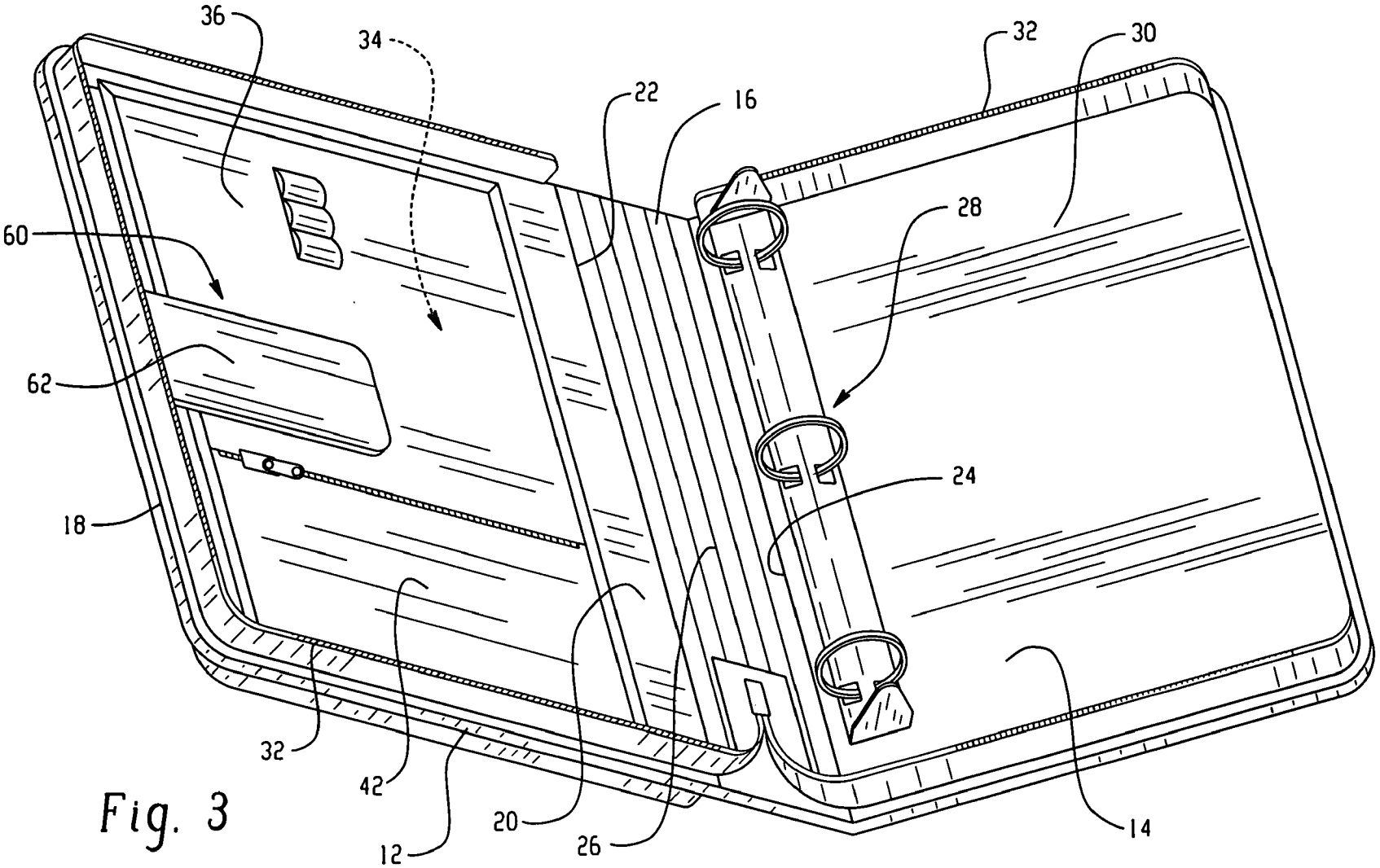
FIG. 3 is a front perspective view of the binder of FIG. 1, with the binder shown in its open position and the pocket in its closed position.
Figure 4:
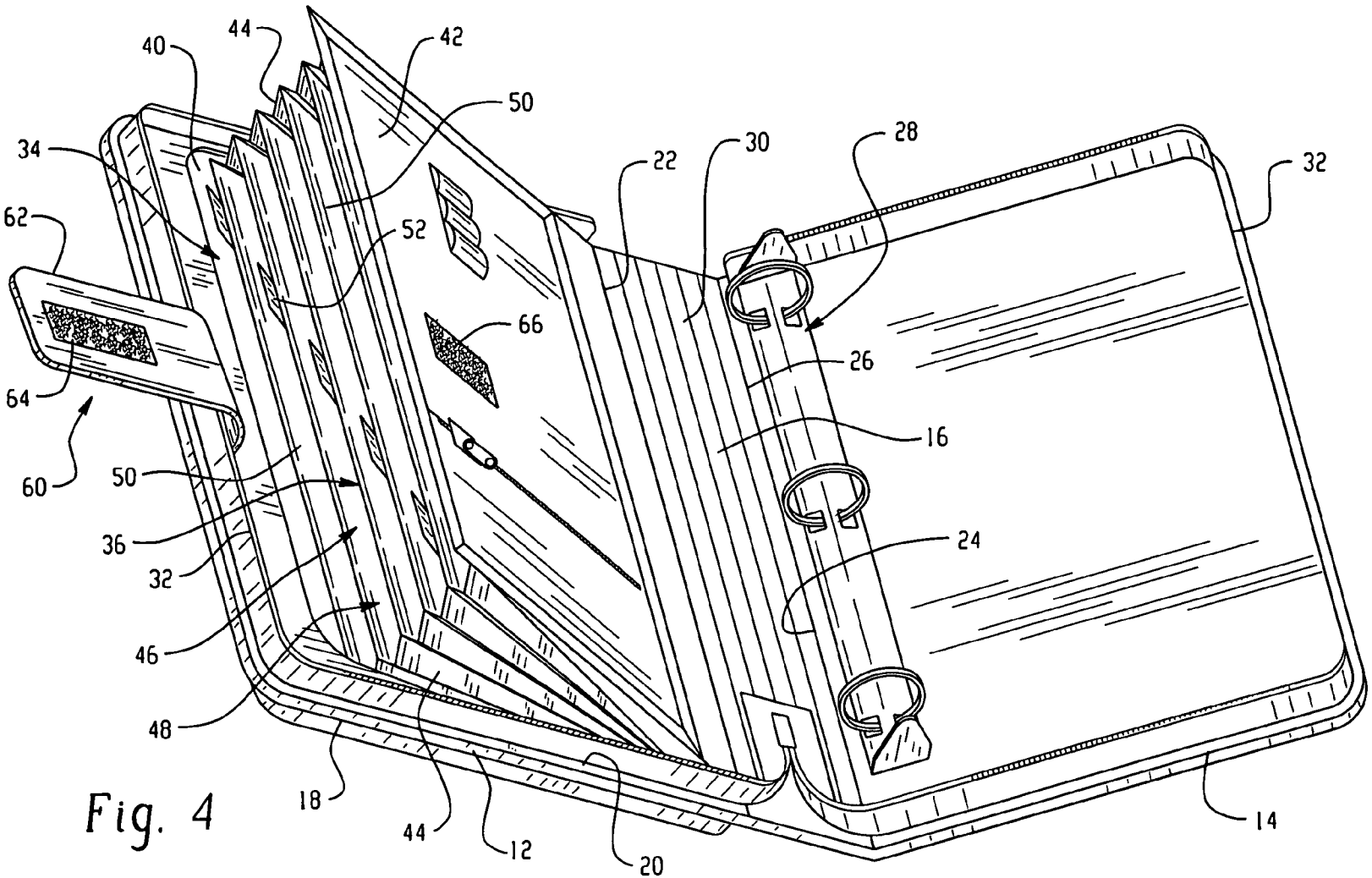
FIG. 4 is a front perspective view of the binder of FIG. 3, with the pocket in a second open position.

The binder 10 is movable between a closed position wherein the front 12 and rear 14 covers are generally parallel and facing each other (FIGS. 1 and 2) and an open position wherein the front 12 and rear 14 covers are generally not parallel, and/or are not generally facing each other (FIGS. 3 and 4). As shown in FIGS. 3 and 4, each of the front 12 and rear 14 covers may include a zipper 32 or other fastening component located about the outer edges thereof so that the front 12 and rear 14 covers can be releasably attached together (i.e., by the zipper 32). The fastening component 32 can be operated to maintain the binder 10 in its closed position.

Figure 6:
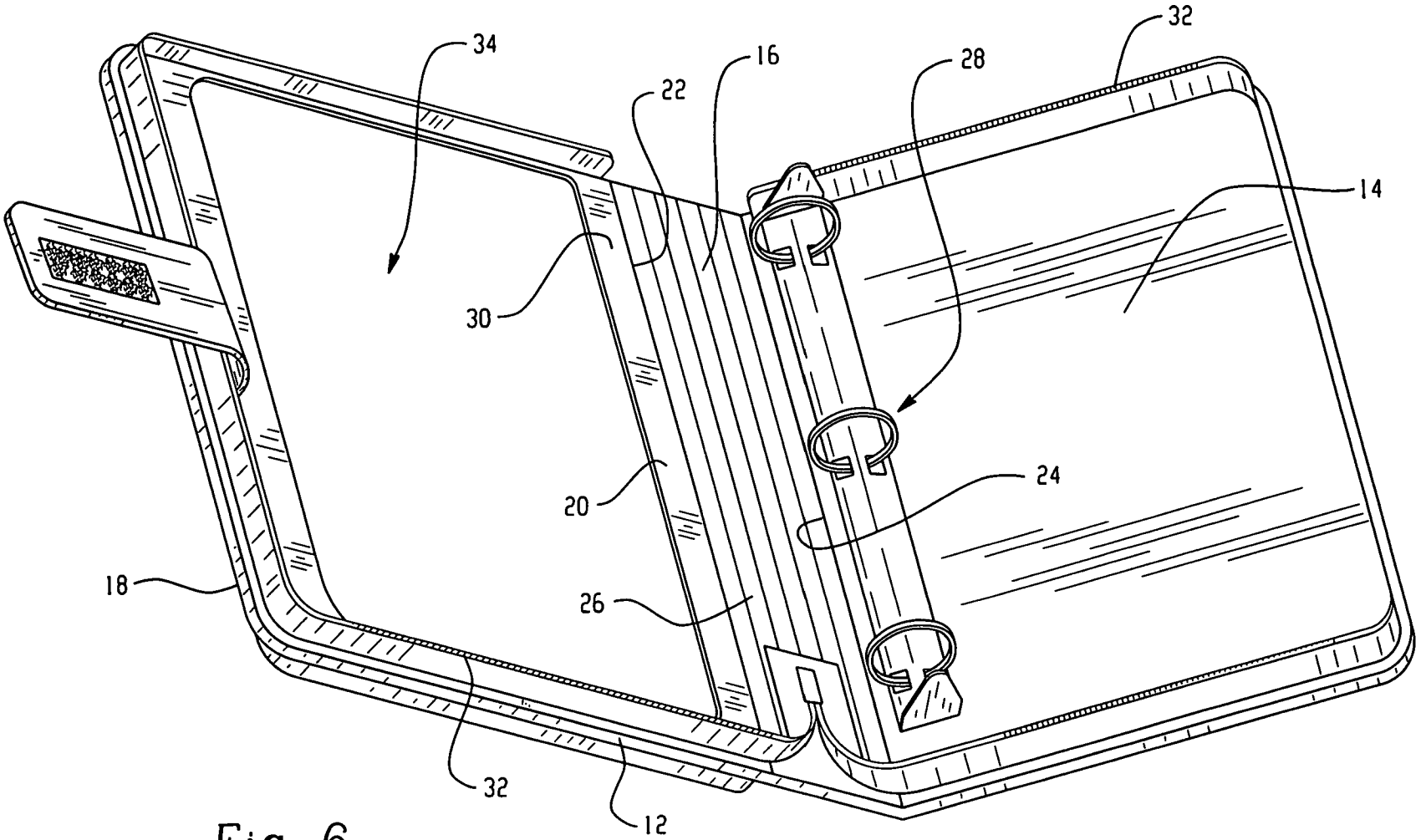
FIG. 6 is a front perspective view of the binder in its open position, with the pocket removed for illustrative purposes.

As shown in FIG. 6, the front cover 12 may include a window, opening or cutout 34 formed therein. The binder 10 may include a pocket 36 located on or coupled to the front cover 12. As can be seen in a comparison between FIG. 4 and FIG. 6, the pocket 36 may be located in the opening 34 of the front cover 12. Although FIG. 6 illustrates the pocket 36 as being entirely separated and removed from the binder 10/front cover 12, the pocket 36 may be fixedly coupled to the binder 10/front cover 12 such that the pocket 36 cannot be removed, and FIG. 6 is presented primarily for illustrative purposes.

The pocket 36 may include a front or first panel 40 and a second or rear panel 42 located generally parallel to and facing the front panel 40. The pocket 36 may further include a pair of side panels 44 (FIG. 4) extending between the front 40 and rear panels 42. In this manner, the front 40 and rear panels 42 and side panels 44 define a pocket cavity 46 having a mouth 48 which extends generally parallel to the hinge line 26.

The side panels 44 may be made of expandable material, such as, in the illustrated embodiment, gusseted material. The pocket 36 may further include a plurality of dividers 50 located in the pocket cavity 46. Each divider 50 may include a tab 52 extending outwardly from the pocket cavity 46 to serve as organization or indexing tools.

The front panel 40 of the pocket 36 includes at least part of a front panel fastening mechanism or releasable fastener 54 for releasably attaching the front panel 40 to the front cover 12. In the illustrated embodiment the front panel fastening mechanism 54 includes a zipper extending around the outer edges of the front panel 40 such that the zipper 54 can be operated to releasably attach the front panel 40 to the front cover 12. The front panel 40 is also fixedly coupled to the front cover 12 along an inner edge 56 thereof. In this manner, when the front panel fastening mechanism 54 is unzipped (i.e., as in FIG. 2), the front panel 40 may be pivotally coupled to the front cover 12.

When the front panel fastening mechanism 54 is unzipped, the front panel 40 can be pivoted away from the front cover 12 to its position shown in FIG. 2. In this configuration, the front panel 40 pulls the side panels 44 and portions of the pocket 36 and pocket cavity 46 through the opening 34 of the front cover 12. In this position, generally all of the pocket cavity 46 is located on the first side 18 of the front cover 12 and generally no portion of the pocket cavity 46 is located on the second side 20 of the front cover 12. Thus, portions of the pocket 36 and pocket cavity 46 are pulled to the first side 18 of the front cover 12 such that the pocket cavity 46 can be accessed and components can be placed into and removed from the pocket 36/pocket cavity 46 from the first side thereof. More particularly, the pocket 36/pocket cavity 46 can be accessed by a user without having to reach through or break the plane of the front cover 12. In this position, generally all of the pocket cavity 46 is located on the first side 18 of the front cover 12 and no part of the pocket cavity 46 is located on the second side 20 of the front cover 12. Once the pocket 36/pocket cavity 46 has been accessed as desired, the front panel fastening mechanism 54 may be zipped to its closed position to retain the components of the pocket 36 therein.

Figure 5:
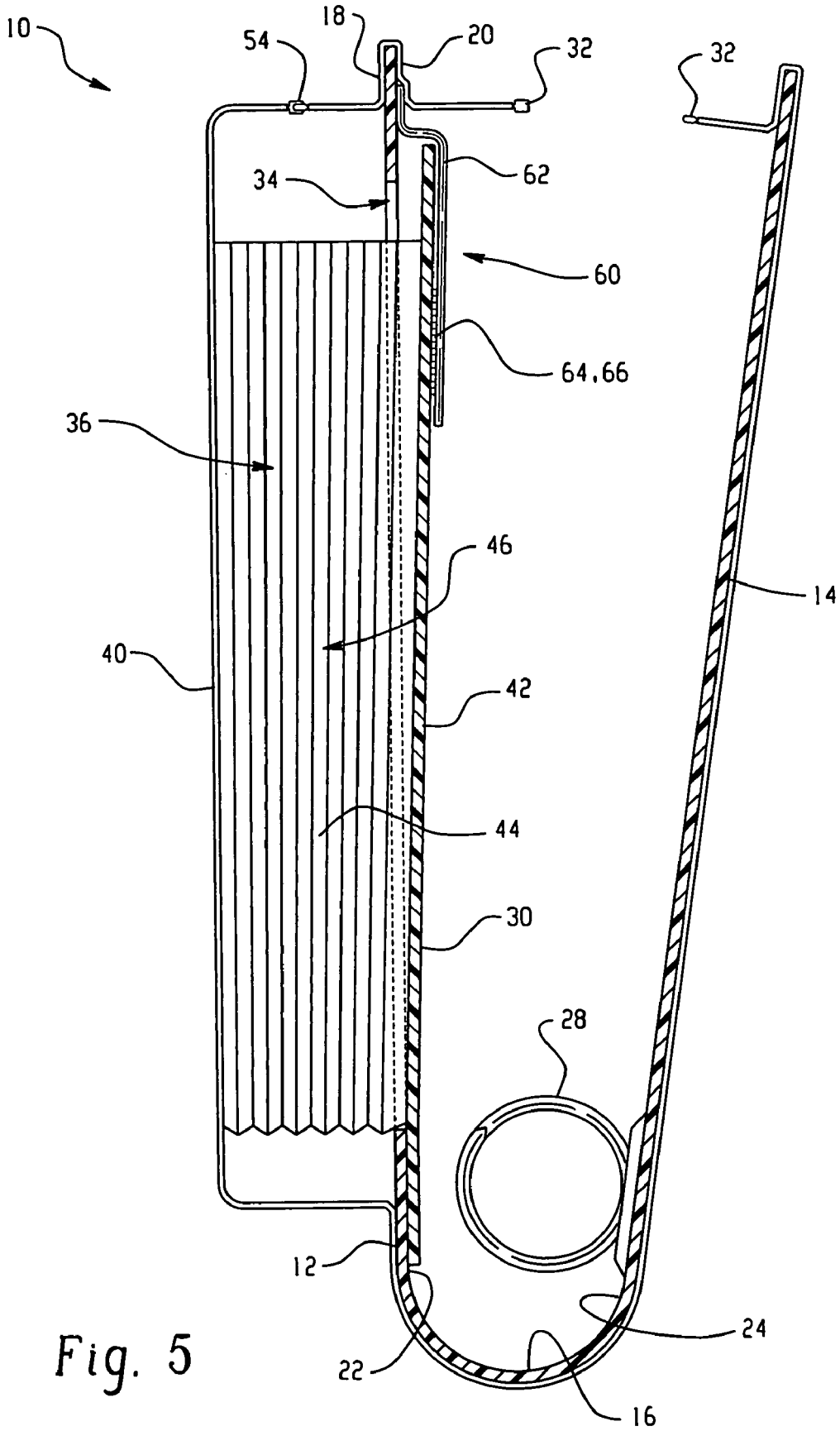
FIG. 5 is a side cross section of the binder of FIG. 1, with the binder partially opened.

As shown in FIG. 5, the rear panel 42 may have a size greater than the opening 34 of the front cover 12 to prevent the rear panel 42 from being pulled through the opening 34 when the binder 10 is in its position shown in FIG. 2. In the illustrated embodiment, the outer edges of the rear panel 42 extend outwardly beyond the opening 34 such that the rear panel 42 generally entirely covers the opening 34 of the front cover as shown in FIG. 5. However, if desired, only certain portions or tabs of the rear panel 42 may extend outwardly beyond the opening 34 to prevent the rear panel 42 from being pulled through the opening 34 of the front cover 12.

The pocket 36 can also be accessed from the second side 20 of the front cover 12, or from inside the binder 10. As shown in FIG. 3, the binder 10 may include a rear panel fastening mechanism 60 which may include an attachment flap 62 fixedly coupled to the inner surface 20 of the front cover 12. The attachment flap 62 includes a strip of hook-and-loop fastening material 64 (such as VELCRO®) located thereon. As shown in FIG. 4, the rear panel 42 of the pocket 34 may include a corresponding patch 66 of hook-and-loop fastening material. In this manner, the patches 64, 66 of hook-and-loop fastening material can cooperate to couple the rear panel 42 to the front cover 12 such that the rear panel 42 pivots with the front cover 12 about the hinge line 26.

When it is desired to access the pocket 36 from the second side 20 of the front cover 12, the attachment flap 62 is separated from the rear panel 42, and the rear panel 42 is pivoted inwardly (i.e., toward the binding mechanism 28) about its hinge line, thereby pulling portions of the side panels 44 and pocket cavity 46 through the opening 34 as shown in FIG. 4. In this manner, portions of the side panels 44 and pocket cavity 46 are located on the second side 20 and inwardly of the plane of the front cover 12 so that components can be added to or removed from the pocket cavity 46 without a user having to reach to the first side 18 or reach across or break the plane of the front cover 12. In this position, generally the entire pocket cavity 46 is located on the second side 20 of the front cover 12 and generally no portion of the pocket cavity 46 is located on the first side 18 of the front cover 12. The front panel 40 of the pocket 36 may be larger than the opening 34 to prevent the front panel 40 from being pulled through the opening 34 when the pocket 36 is being accessed from inside the binder 10 as shown in FIG. 4. Once the user has accessed the pocket 36, the pocket 36 may be returned to its closed position by pressing the rear panel 42 against the front cover 12, and engaging the portions 64, 66 of hook-and-loop attachment material of the attachment flap 62 and rear panel 42 to return the binder 10 to the position shown in FIG. 3.

The pocket 36 may also be movable to a multi-access position such that the pocket cavity 46 can be simultaneously accessed from both the first 18 and second 20 sides of the front cover 12. In particular, the front panel fastening mechanism 54 may be moved to its unzipped position, and the front panel 40 may be pivoted to its position shown in FIG. 2. Simultaneously, the rear panel fastening mechanism 60 is released and the rear panel 42 is moved to its position shown in FIG. 4. In this position, portions of the pocket cavity 46 are located on both sides of the front cover 12 such that the binder 10 provides access from both the first 18 and second sides 20 of the front cover 12.

The multi-access nature of the notebook 10 provides great versatility in utilizing the pocket 36. For example, when a user utilizes the binder 10 in its open position (i.e., taking notes or the like), the user can access the contents of the pocket 36 without having to close the binder 10, flip the binder over, etc. Furthermore, when the binder 10 is in its closed position (i.e., being carried, stored in a locker, backpack or the like), a user can access the pocket 36 without having to open the binder 10. Thus, the binder 10 of the present invention provides improved access and storage capabilities.

Having described the invention in detail and by reference to the preferred embodiments, it will be apparent that modifications and variations thereof are possible without departing from the scope of the invention.

What is claimed is:

1. A binder comprising:

a first cover;

a second cover pivotally coupled to said first cover, both of said covers being generally flat and planar, said first cover including an opening and having a first side and a second side; and a pocket coupled to said first cover and generally received in said opening, said pocket including a first panel and a second panel defining a pocket cavity therebetween, said first panel being larger than said opening and at least portions or tabs of said second panel extending beyond the perimeter of said opening;

a first releasable fastening mechanism to releasably join said first panel and said first cover; and a second releasable fastening mechanism to releasably join said second panel and said first cover;

wherein, when said first panel and said second panel are both releasably joined to said first cover, said pocket is located outside of said first cover.

2. The binder of claim 1 wherein said pocket can be accessed from both said first and second sides of said first cover.

3. The binder of claim 2 wherein said pocket includes a pocket cavity which can be accessed from both said first and second sides of said first cover.

4. The binder of claim 3 wherein said first cover defines a plane, and wherein said first side is located on one side of said plane and said second side is located on an opposite side of said plane, and wherein said pocket cavity can be accessed from said first side without intersecting said plane, and wherein said pocket cavity can be accessed from said second side without intersecting said plane.

5. The binder of claim 1 wherein said first and second panels are each independently pivotally coupled to said first cover.

6. The binder of claim 1 wherein said first panel is directly releasably attachable to said first side of said first cover and said second panel is directly releasably attachable to said second side of said first cover.

7. The binder of claim 1, wherein said pocket may be opened from said first side by releasing only said first releasable fastening mechanism, and wherein said pocket may be opened from said second side by releasing only said second releasable fastening mechanism.

8. The binder of claim 1, wherein said rear panel has a size greater than said opening.

9. The binder of claim 1, wherein said first releasable fastening mechanism is positioned between said first panel and said first cover.

10. The binder of claim 1, wherein said second releasable fastening mechanism is positioned between said second panel and said first cover.

11. The binder of claim 1, wherein said portions or tabs of said rear panel prevent said rear panel from being pulled through the opening.

12. A method for manipulating a binder comprising the steps of:

providing a binder having a first generally planar component, a second generally planar component pivotally coupled to said first planar component, both of said planar components being generally flat and planar and having a first and second opposite sides thereof, and a pocket coupled to said first planar component, said pocket including a front panel and a rear panel defining a pocket cavity therebetween, wherein each panel is independently pivotable relative to the other;

accessing said pocket from said first side of said first planar component; and accessing said pocket from said second side of said first planar component, wherein said first planar component defines a plane, and wherein said first side of said first planar component is located on one side of said plane and said second side of said first planar component is located on an opposite side of said plane, and wherein said first accessing step includes accessing said pocket from said first side without intersecting said plane, and wherein said second accessing step includes accessing said pocket from said second side without intersecting said plane;

wherein said first planar component includes an opening and said pocket is positioned in said opening, and wherein said first side of said first cover is an inner side and said second side of said first cover is an outer side, and wherein said rear panel is generally positioned on said inner surface of said first planar component, and said front panel is positioned on said outer side of said first planar component, and wherein said rear panel includes a protruding portion that protrudes beyond the perimeter of said opening to prevent said rear panel from being pulled through said opening.

13. The method of claim 12 wherein one panel can be pivoted without the other panel pivoting.

* * * * *